US006058359A

United States Patent [19]

Hagen et al.

[11] Patent Number: 6,058,359

[45] Date of Patent: May 2, 2000

[54] SPEECH CODING INCLUDING SOFT ADAPTABILITY FEATURE

[75] Inventors: Roar Hagen, Stockholm; Erik Ekudden, Åkersberga, both of Sweden

[73] Assignee: Telefonaktiebolaget L M Ericsson, Stockholm, Sweden

[21] Appl. No.: 09/034,590

[22] Filed: Mar. 4, 1998

[51] Int. Cl.[7] ..... G10L 9/00

[52] U.S. Cl. ..... 704/214; 704/216; 704/219; 704/221; 704/223; 704/229

[58] Field of Search ..... 704/207, 221, 704/209, 214, 216, 219, 223, 229

[56] References Cited

U.S. PATENT DOCUMENTS

| | | | |
|---|---|---|---|
| 5,734,789 | 3/1998 | Swaminathan et al. | 704/210 |
| 5,778,338 | 7/1998 | Jacobs et al. | 704/223 |
| 5,787,389 | 7/1998 | Taumi et al. | 704/219 |
| 5,878,387 | 3/1999 | Oshikiri et al. | 704/207 |

FOREIGN PATENT DOCUMENTS

| | | | |
|---|---|---|---|
| 0573398 | 12/1993 | European Pat. Off. | G10L 9/14 |
| 0596847 | 5/1994 | European Pat. Off. | G01L 9/14 |
| 0654909 | 5/1995 | European Pat. Off. | H03M 7/30 |

OTHER PUBLICATIONS

IBM Technical Disclosure Bulletin, vol. 27, No. 10A, Mar. 1985, "Phoneme–Class–Based Switch for Selecting Speech–Coding Techniques/Parameters", XP–002065009.

*Primary Examiner*—David R. Hudspeth
*Assistant Examiner*—Susan Wieland
*Attorney, Agent, or Firm*—Jenkens & Gilchrist, P.C.

[57] ABSTRACT

Adaptive speech coding includes receiving an original speech signal, performing on the original speech signal a current coding operation, and adapting the current coding operation in response to information used in the current coding operation. Adaptive speech decoding includes receiving coded information, performing a current decoding operation on the coded information, and adapting the current decoding operation in response to information used in the current decoding operation.

54 Claims, 8 Drawing Sheets

SPEECH CODING INCLUDING SOFT ADAPTABILITY FEATURE

FIELD OF THE INVENTION

The invention relates generally to speech coding and, more particularly, to adapting the coding of a speech signal to local characteristics of the speech signal.

BACKGROUND OF THE INVENTION

Most conventional speech coders apply the same coding method regardless of the local character of the speech segment to be encoded. It is, however, recognized that enhanced quality can be achieved if the coding method is changed, or adapted, according to the local character of the speech. Such adaptive methods are commonly based on some form of classification of a given speech segment, which classification is used to select one of several coding modes (multi-mode coding). Such techniques are especially useful when there is background noise which, in order to obtain a natural sounding reproduction thereof, requires coding approaches that differ from the coding technique generally applied to the speech signal itself.

One disadvantage associated with the aforementioned classification schemes is that they are somewhat rigid; giving rise to the danger of mis-classifying a given speech segment and, as a result, selecting an improper coding mode for that segment. The improper coding mode typically results in severe degradation in the resulting coded speech signal. The classification approach thus disadvantageously limits the performance of the speech coder.

A well-known technique in multi-mode coding is to perform a closed-loop mode decision where the coder tries all modes and decides on the best according to some criterion. This alleviates the mis-classification problem to some extent, but it is a problem to find a good criterion for such a scheme. It is, as is also the case for aforementioned classification schemes, necessary to transmit information (i.e., send overhead bits from the transmitter's encoder through the communication channel to the receiver's decoder) describing which mode is chosen. This restricts the number of coding modes in practice.

It is therefore desirable to permit a speech coding (encoding or decoding) procedure to be changed or adapted based on the local character of the speech without the severe degradations associated with the aforementioned conventional classification approaches and without requiring transmission of overhead bits to describe the selected adaptation.

According to the present invention, a speech coding (encoding or decoding) procedure can be adapted without rigid classifications and the attendant risk of severe degradation of the coded speech signal, and without requiring transmission of overhead bits to describe the selected adaptation. The adaptation is based on parameters already existing in the coder (encoder or decoder) and therefore no extra information has to be transmitted to describe the adaptation. This makes possible a completely soft adaptation scheme where an infinite number of modifications of the coding (encoding or decoding) method is possible. Furthermore, the adaptation is based on the coder's characterization of the signal and the adaptation is made according to how well the basic coding approach works for a certain speech segment.

DETAILED DESCRIPTION

Figure 1:
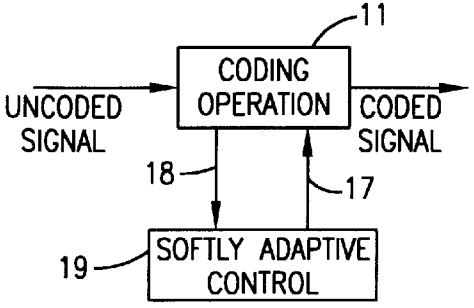
FIG. 1 is a block diagram which illustrates generally a softly adaptive speech encoding scheme according to the invention.

Example FIG. 1 illustrates in general the application of the present invention to a speech encoding process. The arrangement of FIG. 1 could be utilized, for example, in a wireless speech communication device such as, for example, a cellular telephone. A speech encoding arrangement at 11 receives at an input thereof an uncoded signal and provides at an output thereof a coded speech signal. The uncoded signal is an original speech signal. The speech encoding arrangement at 11 includes a control input 17 for receiving control signals from a softly adaptive controller 19. The control signals from the controller 19 indicate how much the encoding operation performed by encoding arrangement 11 is to be adapted. The controller 19 includes an input 18 for receiving from the encoder 11 information indicative of the local speech characteristics of the uncoded signal. The controller 19 provides the control signals at 17 in response to the information received at 18.

Figure 1A:
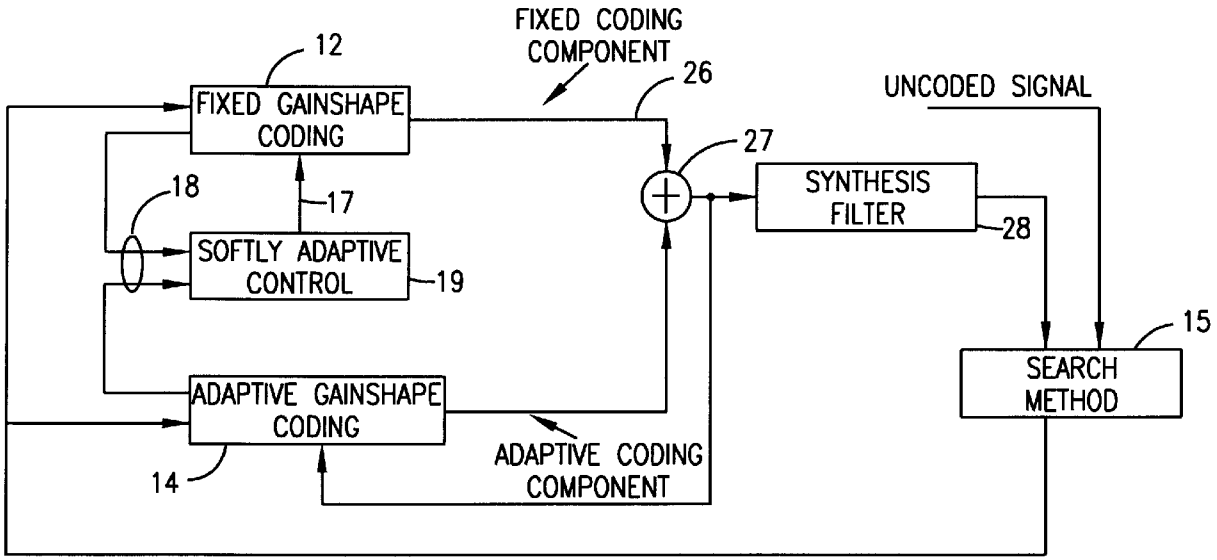
FIG. 1A illustrates the arrangement of FIG. 1 in greater detail.

FIG. 1A illustrates an example of a speech encoding arrangement of the general type shown in FIG. 1, including an encoder and softly adaptive control according to the invention. FIG. 1A shows pertinent portions of a Code Excited Linear Prediction (CELP) speech encoder including a fixed gainshape portion 12 and an adaptive gainshape portion 14. Softly adaptive control is provided to the fixed gainshape portion 12 to permit soft adaptation of the fixed gainshape coding method implemented by the portion 12.

Figure 2:
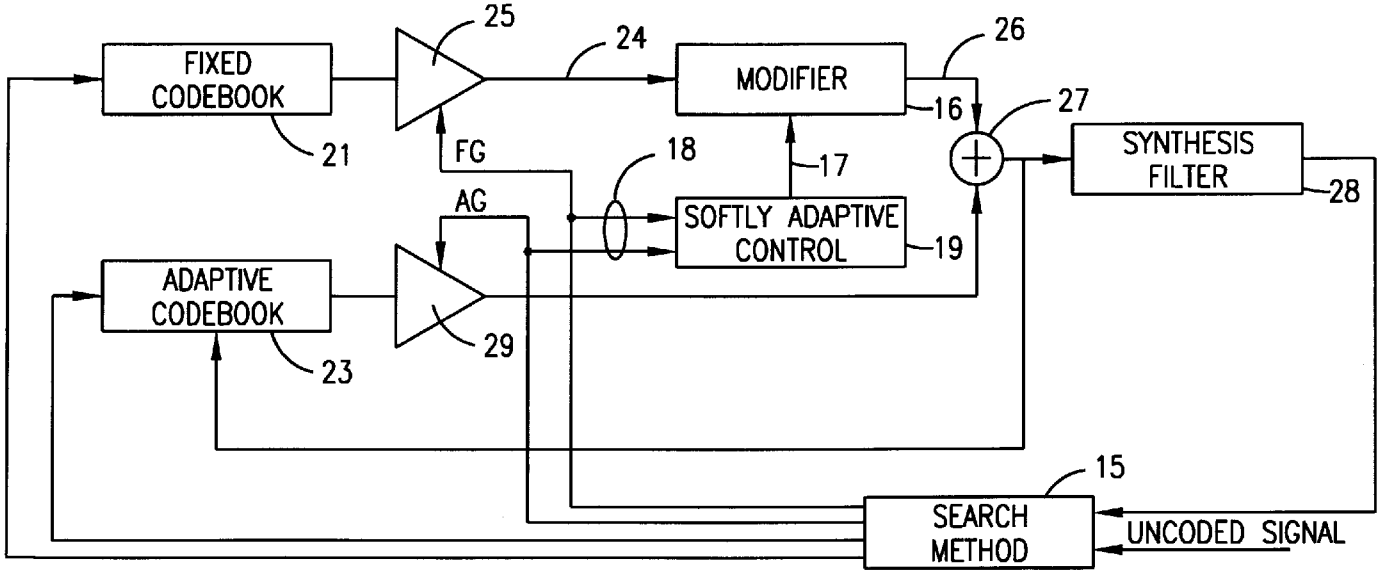
FIG. 2 illustrates in greater detail the arrangement of FIG. 1A.

FIG. 2 illustrates in more detail the example CELP encoding arrangement of FIG. 1A. As shown in FIG. 2, the fixed gainshape coding portion 12 of FIG. 1A includes a fixed codebook 21, a gain multiplier 25, and a code modifier 16. The FIG. 1A adaptive gainshape coding portion 14 includes an adaptive codebook 23 and a gain multiplier 29. The gain FG applied to the fixed codebook 21 and the gain AG applied to the adaptive codebook 23 are conventionally generated in CELP encoders. In particular, a conventional search method is executed at is in response to the uncoded signal input and the output of synthesis filter 28, as is well known in the art. The search method provides the gains AG and FG, as well as the inputs to codebooks 21 and 23.

The adaptive codebook gain AG and fixed codebook gain FG are input to the controller 19 to provide information indicative of the local speech characteristics. In particular, the invention recognizes that the adaptive codebook gain AG can also be used as an indicator of the voicing level (i.e. strength of pitch periodicity) of the current speech segment, and the fixed codebook gain FG can also be used as an indicator of the signal energy of the current speech segment. At a conventional 8 kHz sampling rate, a respective block of, for example, 40 samples is accessed every 5 milliseconds from each of the conventional adaptive and fixed codebooks 21 and 23. For the speech segment represented by the respective blocks of samples currently being accessed from the fixed codebook 21 and the adaptive codebook 23, AG provides the voicing level information and FG provides the signal energy information.

A code modifier 16 receives at 24 a coded signal estimate from the fixed codebook 21, after application of the gain FG at 25. The modifier 16 then provides at 26 a selectively modified coded signal estimate for a summing circuit 27. The other input of summing circuit 27 receives the coded signal estimate output from the adaptive codebook 23, after application of the adaptive codebook gain AG at 29, as is conventional. The output of summing circuit 27 drives the conventional synthesis filter 28, and is also fed back to the adaptive codebook 23.

If the adaptive codebook gain AG is high, then the coder is utilizing the adaptive codebook component heavily, so the speech segment is likely a voiced speech segment, which is typically processed acceptably by the CELP coder with little or no adaptation of the coding process. If AG is low, the signal is likely either unvoiced speech or background noise. In this low AG situation, the modifier 16 should advantageously provide a relatively high level of coding modification. In ranges between a high adaptive codebook gain and a low adaptive codebook gain, the amount of modification required is preferably somewhere between the relatively high level of modification associated with a low adaptive codebook gain and the relatively low or no modification associated with a high adaptive codebook gain.

Figure 3:
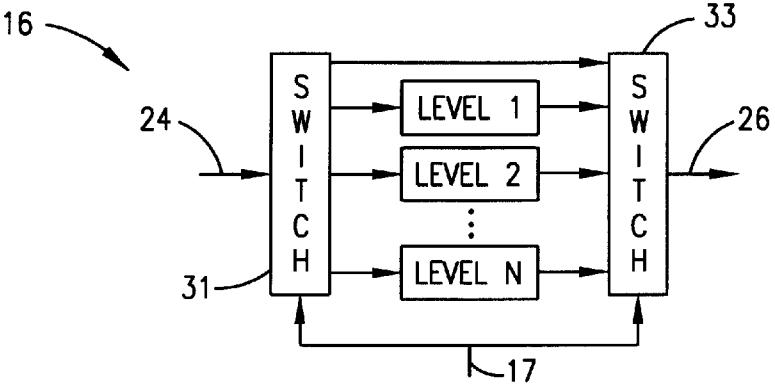
FIG. 3 illustrates the multi-level code modifier of FIGS. 2 and 21 in more detail.

Example FIG. 3 illustrates in more detail the FIG. 2 code modifier 16. As shown in example FIG. 3, the control signals received at 17 from controller 19 operate switches 31 and 33 to select a desired level of modification of the coded signal estimate received at 24. As shown in FIG. 3, modification level 0 passes the coded signal estimate with no modification. In one embodiment, modification level 1 provides a relatively low level of modification, modification level 2 provides a level of modification which is relatively higher than that provided by modification level 1, and both modification levels 1 and 2 provide less code modification than is provided, for example, by modification level N. Thus, the soft adaptive controller uses the adaptive codebook gain (voicing level information) and the fixed codebook gain (signal energy information) to select how much (what level of) modification the code modifier 16 will apply to the coded signal estimate. Because this gain information is already generated by the coder in its coding process, no overhead is needed to produce the desired voicing level and signal energy information.

Although the adaptive codebook gain and fixed codebook gain are used to provide respectively information regarding the voicing level and the signal energy, other appropriate parameters may provide the desired voicing level and signal energy information (or other desired information) when the soft adaptive control techniques of the present invention are incorporated in speech coders other than CELP coders.

Figure 4:
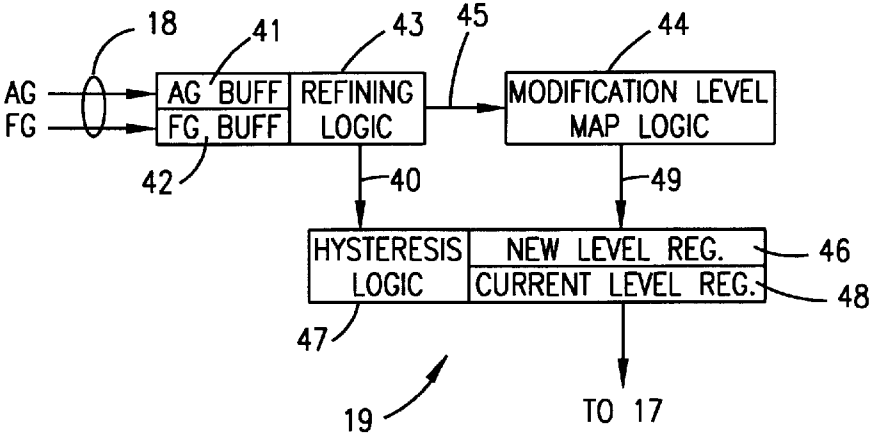
FIG. 4 illustrates one example of the softly adaptive controller of FIGS. 2 and 21.

Example FIG. 4 is a block diagram which illustrates the FIG. 2 embodiment of the softly adaptive controller 19 in greater detail. The adaptive codebook gain AG and fixed codebook gain FG for each speech segment are received and stored in respective buffers 41 and 42. The buffers 41 and 42 are used to store the gain values of the present speech segment as well as the gain values of a predetermined number of preceding speech segments. The buffers 41 and 42 are connected to refining logic 43. The refining logic 43 has an output 45 connected to a code modification level map 44. The code modification level map 44 (e.g. a look-up table) provides at an output 49 thereof a proposed new level of modification to be implemented by the code modifier 16. This new level of modification is stored in a new level register 46. The new level register 46 is connected to a current level register 48, and hysteresis logic 47 is connected to both registers 47 and 48. The current level register 48 provides the desired modification level information to the input 17 of code modifier 16. The code modifier 16 then operates switches 31 and 33 to provide the level of modification indicated by the current level register 48.

Figure 5:
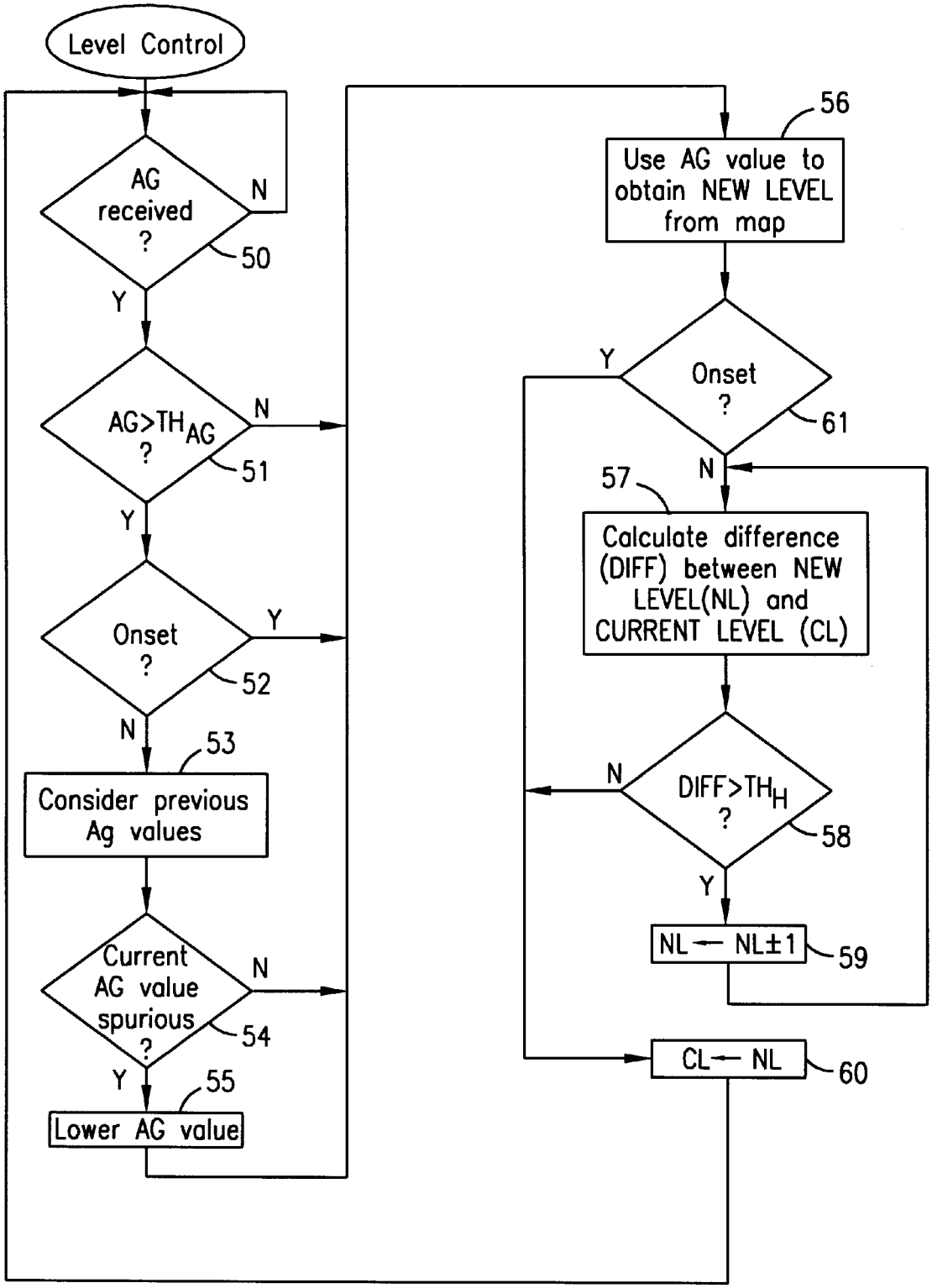
FIG. 5 is a flow diagram which illustrates the operation of the softly adaptive controller of FIG. 4.

The structure and operation of the softly adaptive controller of FIG. 4 is further understood with reference to the flow chart of FIG. 5.

FIG. 5 illustrates one example of the level control operation performed by the softly adaptive controller embodiment illustrated in FIGS. 2 and 4. At 50 in FIG. 5, the softly adaptive controller waits to receive the adaptive codebook gain AG associated with the latest block of samples obtained from the adaptive codebook. After AG is received, the refining logic 43 of FIG. 4 determines at 51 whether this new adaptive codebook gain value is greater than a threshold value $TH_{AG}$. If not, then the adaptive codebook gain value AG is used at 56 to obtain the NEW LEVEL value from the map 44 of FIG. 4. Thus, when the adaptive codebook gain value does not exceed the threshold $TH_{AG}$, the refining logic 43 of FIG. 4 passes the adaptive codebook gain value to the code modification level map 44 of FIG. 4, where the adaptive codebook gain value is used to obtain the NEW LEVEL value.

In one embodiment of the invention, adaptive codebook gain values in a first range are mapped into a NEW LEVEL value of 0 (thus selecting level 0 in the code modifier of FIG. 3), gain values in a second range are mapped to a NEW LEVEL value of 1 (thus selecting the level 1 modification in the coding modifier of FIG. 3), gain values in a third range map into a NEW LEVEL value of 2 (corresponding to selection of the level 2 modification in the code modifier 16), and so on. Each gain value can be mapped into a unique NEW LEVEL value provided the modifier 11 has enough modification levels. As the ratio of modification levels to AG values increases, changes in modification level can be more subtle (even approaching infinitesinial), thus providing a "soft" adaptation to changes in AG.

If the adaptive codebook gain value exceeds the threshold at 51, the refining logic 43 of FIG. 4 examines the fixed codebook gain buffer 42 to determine whether the over-threshold AG value corresponds to a large increase in the FG value, which increase in FG would indicate that a speech onset is occurring. If an onset is detected at 52, then at 56 the adaptive codebook gain value is applied to the map (see 44 in FIG. 4).

If no onset is indicated at 52, then the refining logic (see 43 in FIG. 4) considers earlier values of the adaptive codebook gain as stored in the buffer 41 in FIG. 4. Although the current AG value is an over-threshold value from step 51, nevertheless, previous AG values are considered at 53 in order to determine at 54 whether or not the over-threshold AG value is a spurious value. Examples of the type of processing which can be implemented at 53 are a smoothing operation, an averaging operation, other types of filtering operations, or simply counting the number of previous AG values that did not exceed the threshold value $TH_{AG}$. For example, if half or more of the AG values in the buffer 41 do not exceed the threshold $TH_{AG}$, then the "yes" path (spurious AG value) is taken from block 54 and the refining logic (43 in FIG. 4) lowers the AG value at 55. As mentioned above, the lower AG values tend to indicate a lower level of voicing, so the lower AG value will preferably map into a higher NEW LEVEL value that will result in a relatively large modification of the coded speech estimation. Note that an over-threshold AG value is accepted without considering previous AG values if an onset is detected at 52. If no spurious AG value is detected at 53 and 54, then the over-threshold AG value is accepted, and at 56 is applied to map 44.

It should be appreciated that the availability and consideration of previous information used by the coder, such as AG values, for example at 53–55 of FIG. 5, permits a high-resolution, "softly" adaptive control wherein an infinite number of modifications or adaptations of the coding method is possible.

At 57 in FIG. 5, the hysteresis logic (see 47 in FIG. 4) compares the NEW LEVEL value (NL) to the CURRENT LEVEL value (CL) to obtain the difference (DIFF) between those values. If at 58 the difference DIFF exceeds a hysteresis threshold value $TH_H$, then at 59 the hysteresis logic either increments or decrements the NEW LEVEL value as necessary to move it closer to the CURRENT LEVEL value. Thereafter, the NEW LEVEL and CURRENT LEVEL values are again compared at 57 to determine the difference DIFF therebetween. It is thereafter determined again at 58 whether DIFF exceeds the hysteresis threshold and, if so, the NEW LEVEL value is again moved closer to the CURRENT LEVEL value at 59, and the difference DIFF is again determined at 57. Whenever the difference DIFF is found not to exceed the hysteresis threshold at 58, then at 60 the hysteresis logic (47 in FIG. 4) permits the NEW LEVEL value to be written into the CURRENT LEVEL register 48. The CURRENT LEVEL value from the register 48 is connected to switch control input 17 of the code modifier of FIG. 3, thereby to select the desired level of modification.

It will be noted from the foregoing that the hysteresis logic 47 limits the number of levels by which the modification can change from one speech segment to the next. However, note that the hysteresis operation at 57–59 is bypassed from decision block 61 if the refining logic determines from the fixed codebook gain buffer that a speech onset is occurring. In this instance, the refining logic 43 disables the hysteresis operation of the hysteresis logic 47 (see control line 40 in FIG. 4). This permits the NEW LEVEL value to be loaded directly into the CURRENT LEVEL register 48. Thus, hysteresis is not applied in the event of a speech onset.

The above-described use of AG and FG to control the adaptation decisions advantageously requires no bit transmission overhead because AG and FG are produced by the coder itself based on its own characterization of the uncoded input signal.

Figure 20:
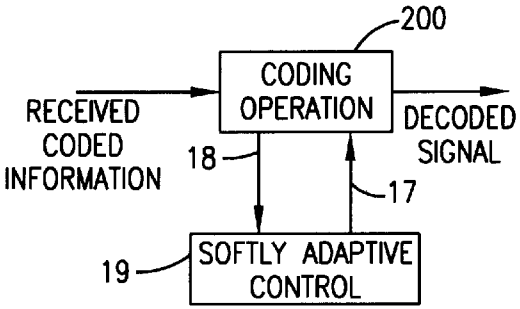
FIG. 20 is a block diagram which illustrates generally a softly adaptive speech decoding scheme according to the invention.

Example FIG. 20 illustrates in general the application of the present invention to a speech decoding process. The arrangement of FIG. 20 could be utilized, for example, in a wireless speech communication device such as, for example, a cellular telephone. A speech decoding arrangement at 200 receives coded information at an input thereof and provides a decoded signal at an output thereof. The coded information received at the input of decoder 200 represents, for example, the received version of the coded signal output by the coder 11 of FIG. 1 and transmitted through a communication channel to the decoder 200. The softly adaptive control 19 of the present invention is applied to the decoder 200 in analogous fashion to that described above with respect to the encoder 11 of FIG. 1.

Figure 20A:
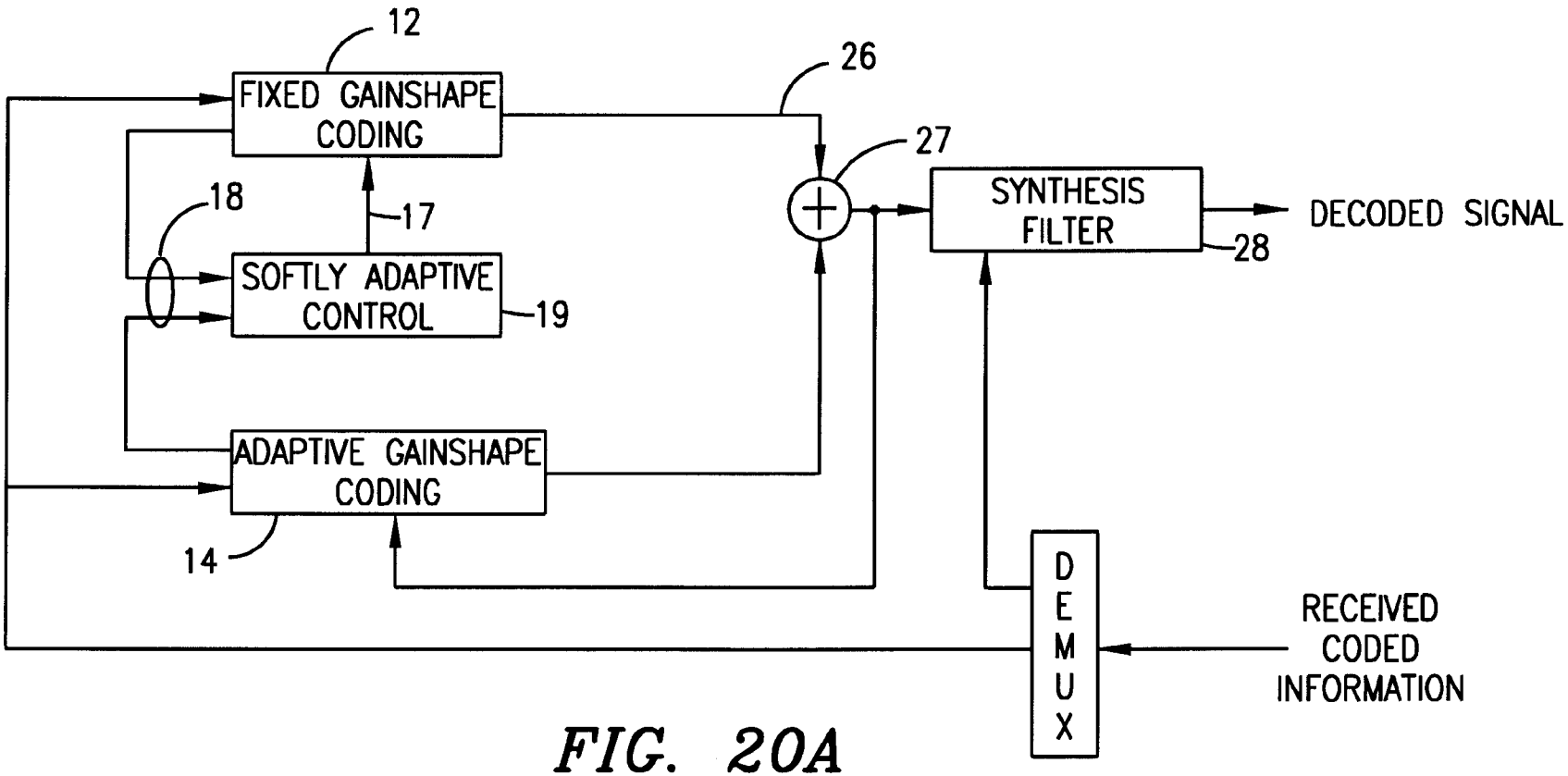
FIG. 20A illustrates the arrangement of FIG. 20 in greater detail.

FIG. 20A illustrates an example of a speech decoding arrangement of the general type shown in FIG. 20, including a decoder and softly adaptive control according to the invention. FIG. 20A shows pertinent portions of a CELP speech decoder. The CELP decoding arrangement of FIG. 20A is similar to the CELP coding arrangement shown in FIG. 1A, except the inputs to the fixed and adaptive gain-shape coding portions 12 and 14 are obtained by demultiplexing the coded information received at the decoder input (as is conventional), whereas the inputs to those portions of the FIG. 1A encoder are obtained from the conventional search method. These relationships among CELP encoders and CELP decoders are well known in the art. In FIG. 20A, as in FIG. 1A, the softly adaptive control 19 of the present invention is applied to the fixed gainshape coding portion 12, and in a manner generally analogous to that described relative to FIG. 1A.

Figure 21:
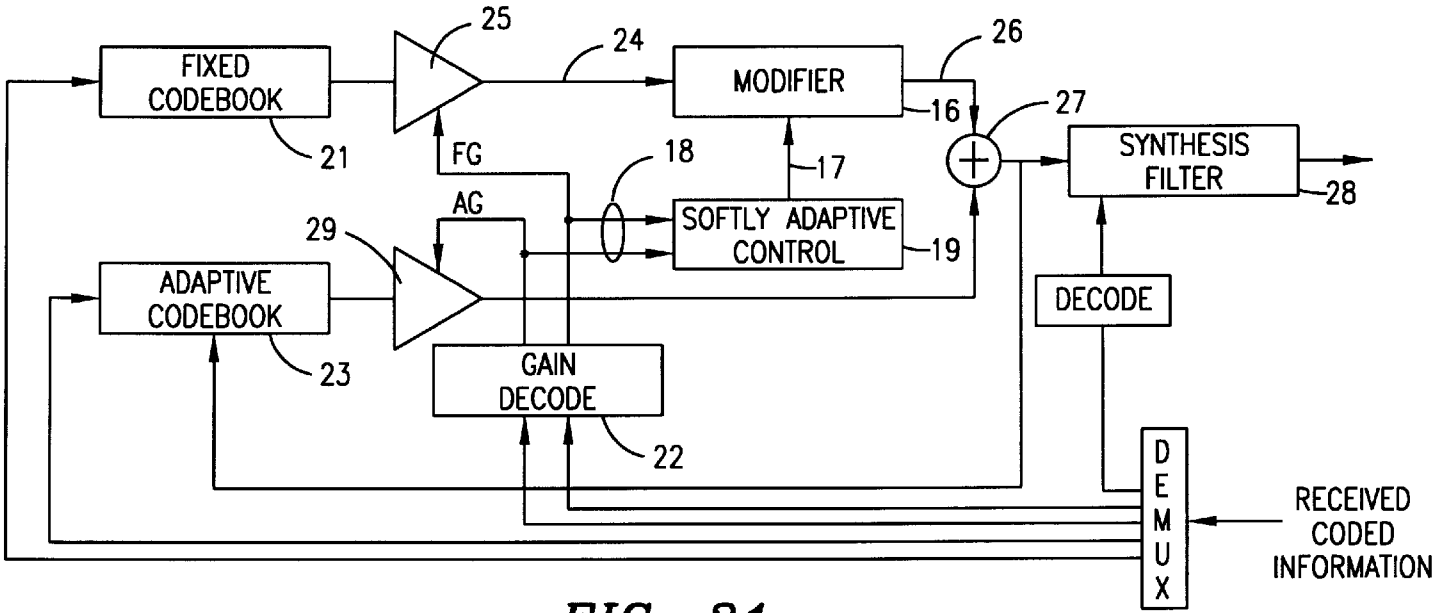
FIG. 21 illustrates in greater the detail the arrangement of FIG. 20A.

As seen more clearly in example FIG. 21, which shows the arrangement of FIG. 20A in greater detail, the application of the softly adaptive control 19 of the present invention in the decoder arrangement of FIG. 21 is analogous to its implementation in the encoder management of FIG. 2. As mentioned above, the inputs to the fixed and adaptive codebooks 21 and 23 are demultiplexed from the received coded information. A gain decoder 22 also receives input signals which have been demultiplexed from the coded information received at the decoder, as is conventional. It should be clear from a comparison of FIGS. 2 and 21 that the softly adaptive control of the present invention operates in the decoder of FIG. 21 in a manner analogous to that described relative to the encoder of FIG. 2. It will therefore be understood that the foregoing description of the application of the softly adaptive control of the present invention with respect to the encoder of FIG. 2 (including FIGS. 3–5 and corresponding text) is analogously applicable to the decoder of FIG. 21.

Figure 6:
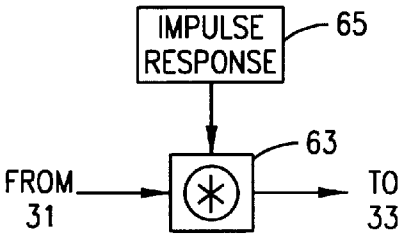
FIG. 6 illustrates diagrammatically an anti-sparseness filter according to the invention which may be provided as one of the modifier levels in the multi-level code modifier of FIG. 3.

FIG. 6 illustrates an example implementation of one of the modification levels of the code modifier of FIG. 3. The arrangement of FIG. 6 can be characterized as an anti-sparseness filter designed to reduce sparseness in the coded speech estimation received from the fixed codebook of FIG. 2 or FIG. 21. Sparseness refers in general to the situation wherein only a few of the samples of a given codebook entry in the fixed codebook 21, for example an algebraic codebook, have a non-zero sample value. This sparseness condition is particularly prevalent when the bit rate of the algebraic codebook is reduced in an effort to provide speech compression. With very few non-zero samples in the codebook entries, the resulting sparseness is an easily perceived degradation in the coded speech signals of conventional speech coders.

The anti sparseness filter illustrated in FIG. 6 is designed to alleviate the sparseness problem. The anti-sparseness filter of FIG. 6 includes a convolver 63 that performs a circular convolution of the coded speech estimate received from the fixed (e.g. algebraic) codebook 21 with an impulse response (at 65) associated with an all-pass filter. The operation of one example of the FIG. 6 anti-sparseness filter is illustrated in FIGS. 7–11.

Figure 7:
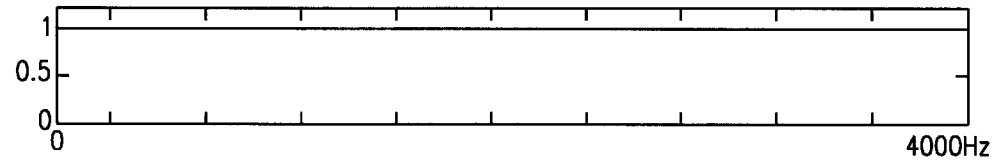
FIGS. 7–11 illustrate graphically the operation of an anti-sparseness filter of the type illustrated in FIG. 6.
Figure 8:
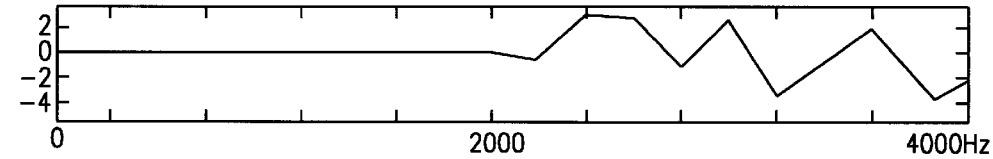
Figure 10:
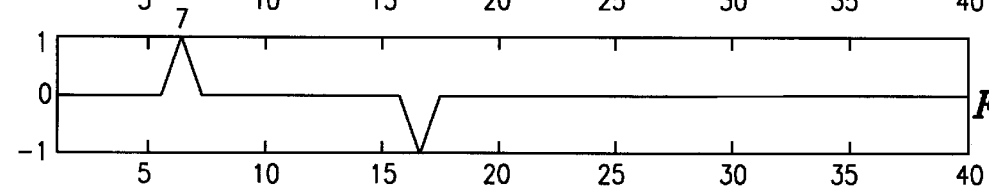

FIG. 10 illustrates an example of an entry from the codebook 21 of FIG. 2 (or FIG. 21) having only two nonzero samples out of a total of forty samples. This sparseness characteristic will be reduced if the number of non-zero samples can be increased. One way to increase the number of non-zero samples is to apply the codebook entry of FIG. 10 to a filter having a suitable characteristic to disperse the energy throughout the block of forty samples. FIGS. 7 and 8 respectively illustrate the magnitude and phase (in radians) characteristics of an all-pass filter which is operable to appropriately disperse the energy throughout the forty samples of the FIG. 10 codebook entry. The filter of FIGS. 7 and 8 alters the phase spectrum in the high frequency area between 2 and 4 kHz, while altering the low frequency areas below 2 kHz only very marginally.

Figure 9:
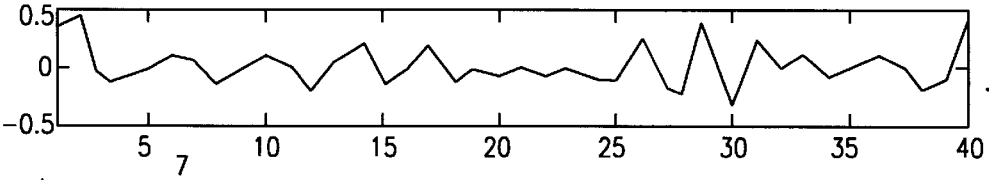

Example FIG. 9 illustrates graphically the impulse response of the all-pass filter defined by FIGS. 7 and 8. The anti-sparseness filter of FIG. 6 produces a circular convolution of the FIG. 9 impulse response on the FIG. 10 block of samples. Because the codebook entries are provided from the codebook as blocks of forty samples, the convolution operation is performed in blockwise fashion. Each sample in FIG. 10 will produce 40 intermediate multiplication results in the convolution operation. Taking the sample at position 7 in FIG. 10 as an example, the first 34 multiplication results are assigned to positions 7–40 of the FIG. 11 result block, and the remaining 6 multiplication results are "wrapped around " by the circular convolution operation such that they are assigned to positions 1–6 of the result block. The 40 intermediate multiplication results produced by each of the remaining FIG. 10 samples are assigned to positions in the FIG. 11 result block in analogous fashion, and sample 1 of course needs no wrap around. For each position in the result block of FIG. 11, the 40 intermediate multiplication results assigned thereto (one multiplication result per sample in FIG. 10) are summed together, and that sum represents the convolution result for that position.

Figure 11:
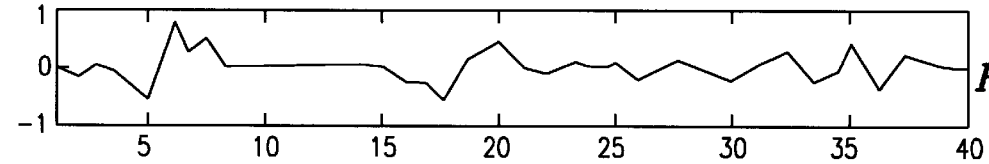
Figure 12:
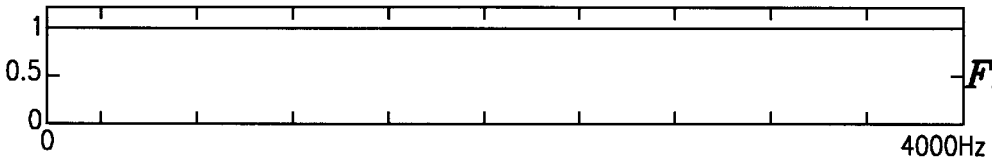
FIGS. 12–16 illustrate graphically the operation of an anti-sparseness filter of the type illustrated in FIG. 6 and at a relatively lower level of anti-spareness operation than the anti-spareness filter of FIGS. 7–11.
Figure 13:
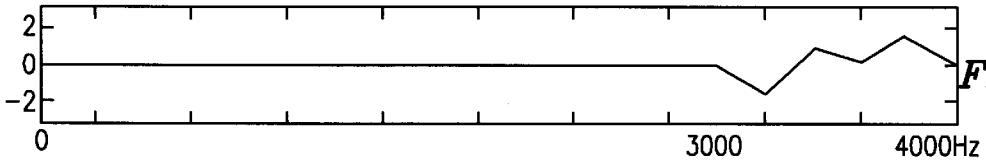

It is clear from inspection of FIGS. 10 and 11 that the circular convolution operation alters the Fourier spectrum of the FIG. 10 block so that the energy is dispersed throughout the block, thereby dramatically increasing the number of non-zero samples and correspondingly reducing the amount of sparseness. The effects of performing the circular convolution on a block-by-block basis can be smoothed out by the synthesis filter 28 of FIG. 2 (or FIG. 21).

Figure 14:
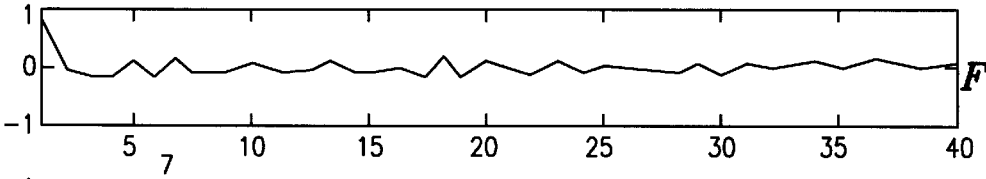
Figure 15:
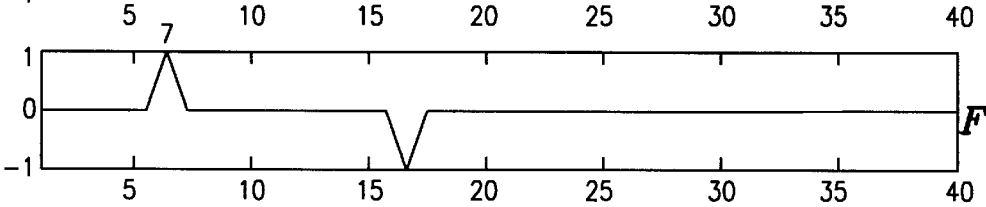
Figure 16:
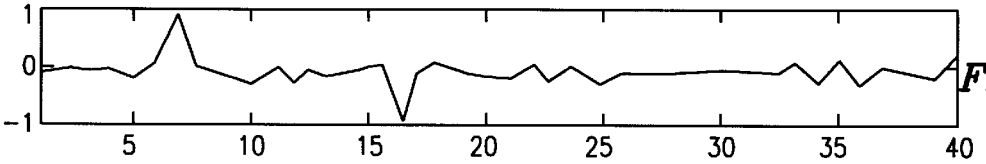

FIGS. 12–16 illustrate another example of the operation of an anti-sparseness filter of the type shown generally in FIG. 6. The all-pass filter of FIGS. 12 and 13 alters the phase spectrum between 3 and 4 kHz without substantially altering the phase spectrum below 3 kHz. The impulse response of the filter is shown in FIG. 14. Referencing FIG. 16, and noting that FIG. 15 illustrates the same block of samples as FIG. 10, it is clear that the anti-sparseness operation illustrated in FIGS. 12–16 does not disperse the energy as much as shown in FIG. 11. Thus, FIGS. 12–16 define an anti-sparseness filter which modifies the codebook entry less than the filter defined by FIGS. 7–11. Accordingly, the filters of FIGS. 7–11 and FIGS. 12–16 define respectively different levels of modification of the coded speech estimate. Referring again to FIGS. 2 and 3, a low AG value indicates that the adaptive codebook component will be relatively small, thus giving rise to the possibility of a relatively large contribution from the fixed (e.g. algebraic) codebook 21. Because of the aforementioned sparseness of the fixed codebook entries, the controller 19 would select the anti-sparseness filter of FIGS. 7–11 rather than that of FIGS. 12–16 because the filter of FIGS. 7–11 provides a greater modification of the sample block than does the filter of FIGS. 12–16. With larger values of adaptive codebook gain AG the fixed codebook contribution is relatively less, and the controller 19 could then select, for example, the filter of FIGS. 12–16 which provides less anti-sparseness modification.

The present invention thus provides the capability of using the local characteristics of a given speech segment to determine whether and how much to modify the coded speech estimation of that segment. Examples of various levels of modification include no modification, an anti-sparseness filter with relatively high energy dispersion characteristics, and an anti-sparseness filter with relatively lower energy dispersion characteristics. In CELP coders in general, when the adaptive codebook gain value is high, this indicates a relatively high voicing level, so that little or no modification is typically necessary. Conversely, a low adaptive codebook gain value typically suggests that substantial modification may be advantageous. In the specific example of an anti-sparseness filter, a high adaptive codebook gain value coupled with a low fixed codebook gain value indicates that the fixed codebook contribution (the sparse contribution) is relatively small, thus requiring less modification from the anti-sparseness filter (e.g. FIGS. 12–16). Conversely, a higher fixed codebook gain value coupled with a lower adaptive codebook gain value indicates that the fixed codebook contribution is relatively large, thus suggesting the use of a larger anti-sparseness modification (e.g. the anti-sparseness filter of FIGS. 7–11). As indicated above, a multi-level code modifier according to the invention can incorporate as many different selectable levels of modification as desired.

Figure 17:
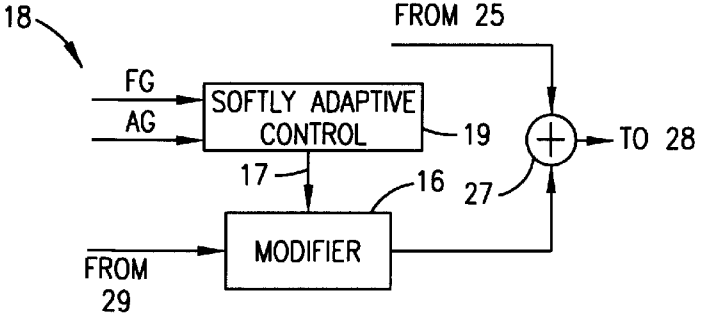
FIG. 17 illustrates a pertinent portion of another speech coding arrangement according to the invention.

FIG. 17 illustrates an exemplary alternative to the FIG. 2 CELP encoding arrangement and the FIG. 21 CELP decoding arrangement, specifically applying the multi-level modification with softly adaptive control to the adaptive codebook output.

Figure 18:
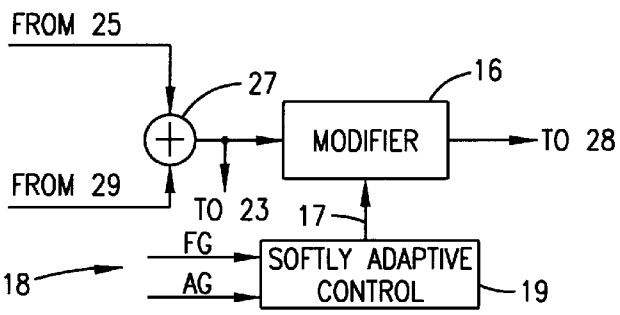
FIG. 18 illustrates a pertinent portion of a further speech coding arrangement according to the invention.

FIG. 18 illustrates another exemplary alternative to the FIG. 2 CELP encoding arrangement and the FIG. 21 CELP decoding arrangement, including the multi-level code modifier and softly adaptive controller applied at the output of the summing gate.

Figure 19:
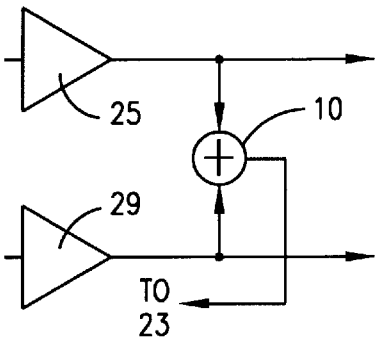
FIG. 19 illustrates a modification applicable to the speech coding arrangements of FIGS. 2, 17 and 21.

Example FIG. 19 shows how the CELP coding arrangements of FIGS. 2, 17 and 21 can be modified to provide feedback to adaptive codebook 23 from a summing circuit 10 whose inputs are upstream of the modifier 16.

It will be evident to workers in the art that the embodiments described above with respect to FIGS. 1–21 can 10 be readily implemented using a suitably programmed digital signal processor or other data processor, and can alternatively be implemented using such suitably programmed digital signal processor or other data processor in combination with additional external circuitry connected thereto.

Although exemplary embodiments of the present invention have been described above in detail, this does not limit the scope of the invention, which can be practiced in a variety of embodiments.

What is claimed is:

1. A speech encoding apparatus for producing a coded representation of an original speech signal, comprising:

an input for receiving the original speech signal;

an output for providing said coded representation of said original speech signal;

a coder coupled between said input and said output for selectively performing on the original speech signal either a coding operation or an adaptation of said coding operation to produce said coded representation; and a controller coupled to said coder to receive therefrom and store information currently being used by said coder in said coding operation, said controller including an output coupled to said coder and responsive to said information currently being used by said coder in said coding operation and to previous information previously used by said coder in said coding operation and stored by said controller for signaling said coder to perform said adaptation of said coding operation.

2. The apparatus of claim 1, wherein said information currently being used in said coding operation includes voicing information indicative of a voicing level of said original speech signal.

3. The apparatus of claim 2, wherein said coding operation and said adaptation thereof include adaptive gainshape coding, and wherein said voicing information includes a gain signal associated with said adaptive gainshape coding.

4. The apparatus of claim 2, wherein said controller includes a memory for maintaining a record of previous voicing levels as indicated by said voicing information, and refining logic operable when said voicing information indicates that a current voicing level exceeds a predetermined threshold to evaluate said current voicing level with respect to said previous voicing levels to determine whether said voicing information indicative of said current voicing level should be used by said controller.

5. The apparatus of claim 1, wherein said information currently being used in said coding operation includes signal energy information indicative of a signal energy in the original speech signal.

6. The apparatus of claim 5, wherein said coding operation and said adaptation thereof include fixed gainshape coding, and wherein said signal energy information includes a gain signal associated with said fixed gainshape coding.

7. The apparatus of claim 5, wherein said information currently being used in said coding operation includes voicing information indicative of a voicing level of said original speech signal.

8. The apparatus of claim 7, wherein said controller includes a memory for maintaining a record of a previous signal energy as indicated by said signal energy information, and refining logic operable when said voicing information indicates that a current voicing level exceeds a predetermined threshold to evaluate a current signal energy with respect to said previous signal energy to determine whether said voicing information indicative of said current voicing level should be used by said controller.

9. The apparatus of claim 1, wherein said coding operation and said adaptation thereof include linear predictive coding.

10. The apparatus of claim 1, wherein said coder is operable to perform any selected one of a plurality of different adaptations of said coding operation in response to said controller output, and wherein said controller includes map logic having an input to receive said information currently being used in said coding operation and having an output that indicates which of said adaptations should be signaled to said coder.

11. The apparatus of claim 10, wherein said controller includes further logic coupled to said map logic output for determining whether the adaptation indicated by said map logic output differs by more than a threshold amount from said coding operation.

12. The apparatus of claim 1, wherein said coder includes an algebraic codebook and said performance of said adaptation includes performing anti-sparseness filtering on a signal received form said algebraic codebook.

13. A speech encoding method for producing a coded representation of an original speech signal, comprising:

receiving the original speech signal;

performing on the original speech signal a current coding operation to produce the coded representation;

responsive to information currently being used in the current coding operation and information used previously in the current coding operation, adapting the current coding operation to produce an adapted coding operation; and performing the adapted coding operation on the original speech signal.

14. The method of claim 13, wherein the information currently being used in the current coding operation includes voicing information indicative of a voicing level of the original speech signal.

15. The method of claim 14, wherein said performing steps include performing adaptive gainshape coding, and wherein said voicing information includes a gain signal associated with the adaptive gainshape coding.

16. The method of claim 14, including maintaining a record of previous voicing levels as indicated by said voicing information and, if said voicing information indicates that a current voicing level exceeds a predetermined threshold, evaluating the current voicing level with respect to the previous voicing levels.

17. The method of claim 16, including modifying the voicing information indicative of the current voicing level to indicate a different voicing level.

18. The method of claim 17, wherein said different voicing level is a lower voicing level.

19. The method of claim 13, wherein the information currently being used in the current coding operation includes signal energy information indicative of a signal energy in the original speech signal.

20. The method of claim 19, wherein said performing steps include Performing fixed gainshape coding, and wherein the signal energy information includes a gain signal associated with the fixed gainshape coding.

21. The method of claim 19, wherein the information currently being used in the current coding operation includes voicing information indicative of a voicing level of the original speech signal.

22. The method of claim 21, including maintaining a record of a previous signal energy as indicated by the signal energy information and, if the voicing information indicates that a current voicing level exceeds a predetermined threshold, evaluating a current signal energy with respect to the previous signal energy to determine whether the current voicing level should be accepted.

23. The method of claim 13, wherein said performing steps include performing linear predicative coding.

24. The method of claim 13, wherein said adapting step includes adapting the current coding operation to produce any selected one of a plurality of dIfferent adaptations of the current coding operation.

25. The method of claim 24, wherein said adapting step includes selecting, in response to the information currently being used in the current coding operation, one of said adaptations to be produced in said adapting step, and thereafter determining a difference between the selected adaptation and the current coding operation.

26. The method of claim 25, wherein said adapting step includes, if the selected adaptation differs from the current coding operation by more than a threshold amount, selecting another adaptation which differs less from the current coding operation.

27. The method of claim 13, wherein said last-mentioned performing step includes performing anti-sparseness filtering on a signal received from an algebraic codebook.

28. A speech decoding apparatus for producing a decoded speech signal from a coded representation of an original speech signal, comprising:

an input for receiving the coded representation of the original speech signal;

an output for providing said decoded speech signal;

a decoder coupled between said input and said output for selectively performing on said coded representation either a decoding operation or an adaptation of said decoding operation to produce said decoded speech signal; and a controller coupled to said decoder to receive therefrom and store information currently being used by said decoder in said decoding operation, said controller including an output coupled to said decoder and responsive to said information currently being used by said decoder in said decoding operation and to previous information used previously by said decoder in said decoding operation and previously stored by said controller for signaling said decoder to perform said adaptation of said decoding operation.

29. The apparatus of claim 28, wherein said information currently being used in said decoding operation includes voicing information indicative of a voicing level of said original speech signal.

30. The apparatus of claim 29, wherein said decoding operation and said adaptation thereof include adaptive gainshape coding, and wherein said voicing information includes a gain signal associated with said adaptive gainshape coding.

31. The apparatus of claim 29, wherein said controller includes a memory for maintaining a record of previous voicing levels as indicated by said voicing information, and refining logic operable when said voicing information indicates that a current voicing level exceeds a predetermined threshold to evaluate said current voicing level with respect to said previous voicing levels to determine whether said voicing information indicative of said current voicing level should be used by said controller.

32. The apparatus of claim 28, wherein said information currently being used in said decoding operation includes signal energy information indicative of a signal energy in the original speech signal.

33. The apparatus of claim 32, wherein said decoding operation and said adaptation thereof include fixed gainshape coding, and wherein said signal energy information includes a gain signal associated with said fixed gainshape coding.

34. The apparatus of claim 32, wherein said information currently being used in said decoding operation includes voicing information indicative of a voicing level of said original speech signal.

35. The apparatus of claim 34, wherein said controller includes a memory for maintaining a record of a previous signal energy as indicated by said signal energy information, and refining logic operable when said voicing information indicates that a current voicing level exceeds a predetermined threshold to evaluate a current signal energy with respect to said previous signal energy to determine whether said voicing information indicative of said current voicing level should be used by said controller.

36. The apparatus of claim 28, wherein said decoding operation and said adaptation thereof include linear predictive coding.

37. The apparatus of claim 28, wherein said decoder is operable to perform any selected one of a plurality of different adaptations of said decoding operation in response to said controller output, and wherein said controller includes map logic having an input to receive said information currently being used in said decoding operation and having an output that indicates which of said adaptations should be signaled to said decoder.

38. The apparatus of claim 37, wherein said controller includes further logic couples to said map logic output for determining whether the adaptation indicated by said map logic output differs by more than a threshold amount from said decoding operation.

39. The apparatus of claim 28, wherein said decoder includes an algebraic codebook and said performance of said adaptation includes performing anti-sparseness filtering on a signal received from said algebraic codebook.

40. A speech decoding method for producing a decoded speech signal from a coded representation of an original speech signal, comprising:

receiving the coded representation of the original speech signal;

performing on the coded representation a current decoding operation to produce the decoded speech signal;

responsive to information currently being used in the current decoding operation and to information previously used in the current decoding operation, adapting the current decoding operation to produce an adapted decoding operation; and performing the adapted decoding operation on the coded representation.

41. The method of claim 40, wherein the information currently being used in the current decoding operation includes voicing information indicative of a voicing level of the original speech signal.

42. The method of claim 41, wherein said performing steps include performing adaptive gainshape coding, and wherein said voicing information includes a gain signal associated with the adaptive gainshape coding.

43. The method of claim 41, including maintaining a record of previous voicing levels as indicated by said voicing information and, if said voicing information indicates that a current voicing level exceeds a predetermined threshold, evaluating the current voicing level with respect to the previous voicing levels.

44. The method of claim 43, including modifying the voicing information indicative of the current voicing level to indicate a different voicing level.

45. The method of claim 44, wherein said different voicing level is a lower voicing level.

46. The method of claim 40, wherein the information currently being used in the current decoding operation includes signal energy information indicative of a signal energy in the original speech signal.

47. The method of claim 46, wherein said performing steps include performing fixed gainshape coding, and wherein the signal energy information includes a gain signal associated with the fixed gainshape coding.

48. The method of claim 46, wherein the information currently being used in the current decoding operation includes voicing information indicative of a voicing level of the original speech signal.

49. The method of claim 48, including maintaining a record of a previous signal energy as indicated by the signal energy information and, if the voicing information indicates that a current voicing level exceeds a predetermined threshold, evaluating a current signal energy with respect to the previous signal energy to determine whether the current voicing level should be accepted.

50. The method of claim 40, wherein said performing steps include performing linear predicative coding.

51. The method of claim 40, wherein said adapting step includes adapting the current decoding operation to produce any selected one of a plurality of different adaptations of the current decoding operation.

52. The method of claim 51, wherein said adapting step includes selecting, in response to the information currently being used in the current decoding operation, one of said adaptations to be produced in said adapting step, and thereafter determining a difference between the selected adaptation and the current decoding operation.

53. The method of claim 52, wherein said adapting step includes, if the selected adaptation differs from the current decoding operation by more than a threshold amount, selecting another adaptation which differs less from the current decoding operation.

54. The method of claim 40, wherein said last-mentioned performing step includes performing anti-sparseness filtering on a signal received from an algebraic codebook.

* * * * *